US010991485B2

(12) United States Patent
Huang et al.

(10) Patent No.: US 10,991,485 B2
(45) Date of Patent: Apr. 27, 2021

(54) COAXIAL CABLE

(71) Applicant: Hitachi Metals, Ltd., Tokyo (JP)

(72) Inventors: Detian Huang, Tokyo (JP); Takanobu Watanabe, Tokyo (JP); Kimika Kudo, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/999,690

(22) Filed: Aug. 21, 2020

(65) Prior Publication Data

US 2021/0065935 A1 Mar. 4, 2021

(30) Foreign Application Priority Data

Aug. 27, 2019 (JP) ..... JP2019-154385

(51) Int. Cl.
*H01B 11/18* (2006.01)
*H01B 1/02* (2006.01)
*H01B 7/22* (2006.01)

(52) U.S. Cl.
CPC ..... *H01B 11/1821* (2013.01); *H01B 1/026* (2013.01); *H01B 7/22* (2013.01); *H01B 11/183* (2013.01)

(58) Field of Classification Search
CPC ... H01B 11/183; H01B 11/18; H01B 11/1821; H01B 11/1813; H01B 11/1808; H01B 11/1878
See application file for complete search history.

(56) References Cited

U.S. PATENT DOCUMENTS 2,080,491 A * 5/1937 Kreisher ..... H01B 11/1808 428/591
3,240,867 A * 3/1966 Maddox ..... H01B 7/065 174/69
4,472,597 A * 9/1984 Uematsu ..... H01B 7/2825 174/106 SC (Continued)

FOREIGN PATENT DOCUMENTS

JP 6164844 B2 7/2017

*Primary Examiner* — Timothy J Thompson
*Assistant Examiner* — Amol H Patel
(74) *Attorney, Agent, or Firm* — McGinn I.P. Law Group, PLLC

(57) ABSTRACT

A coaxial cable includes an inner conductor; an insulator covering a circumference of the inner conductor; a shield layer covering a circumference of the insulator; and a sheath covering a circumference of the shield layer. The inner conductor is composed of first metal strands that are twisted each other in such a manner that a cross-sectional shape of the inner conductor is circular. The shield layer includes a winding shield layer including second metal strands spirally wound around the insulator, and a shield tape layer including a shield tape including a resin tape and a metal layer provided on one side of the resin tape, the shield tape being spirally wound around the winding shield layer with the metal layer being located inwardly radially in such a manner that the metal layer is being in contact with the winding shield layer. The winding shield layer has a gap in at least one location between the second metal strands adjacent to each other in a circumferential direction, and a sum of distances w between the second metal strands adjacent to each other via the gap is not more than an outer diameter d of the second metal strand in a cross-section perpendicular to a longitudinal direction.

8 Claims, 4 Drawing Sheets

(56) References Cited

U.S. PATENT DOCUMENTS

| | | | | | |
|---|---|---|---|---|---|
| 4,599,121 | A * | 7/1986 | Edwards | H01B 7/285 | 156/48 |
| 4,641,110 | A * | 2/1987 | Smith | H01B 11/10 | 174/36 |
| 4,725,693 | A * | 2/1988 | Hirsch | B32B 15/08 | 174/107 |
| 4,847,448 | A * | 7/1989 | Sato | H01B 11/1817 | 174/103 |
| 4,965,412 | A * | 10/1990 | Lai | H01B 11/1808 | 174/106 R |
| 5,023,405 | A * | 6/1991 | Kwast | H01B 7/183 | 174/106 R |
| 5,118,905 | A * | 6/1992 | Harada | H01B 11/1813 | 156/47 |
| 5,254,188 | A * | 10/1993 | Blew | H01B 13/225 | 156/53 |
| 5,374,782 | A * | 12/1994 | Taylor | H01B 11/12 | 174/102 R |
| 5,391,836 | A * | 2/1995 | Bortas | H01B 9/02 | 174/36 |
| 5,739,471 | A * | 4/1998 | Burisch | H01B 11/1016 | 174/102 R |
| 2010/0276176 | A1* | 11/2010 | Amato | H01B 11/1813 | 174/110 R |
| 2012/0073856 | A1* | 3/2012 | Montena | H01B 11/1813 | 174/105 R |
| 2014/0014392 | A1* | 1/2014 | Armbrecht | H01B 11/005 | 174/106 R |
| 2015/0195961 | A1* | 7/2015 | Yanagihara | H05K 9/0098 | 174/350 |
| 2015/0371738 | A1* | 12/2015 | Buck | H01B 1/02 | 174/103 |
| 2016/0099092 | A1* | 4/2016 | Huang | H01B 11/183 | 174/113 R |

* cited by examiner

COAXIAL CABLE

CROSS-REFERENCE TO RELATED APPLICATION

The present application is based on Japanese patent application No. 2019-154385 filed on Aug. 27, 2019, the entire contents of which are incorporated herein by reference.

BACKGROUND OF THE INVENTION

1. Field of the Invention

The present invention relates to a coaxial cable.

2. Description of the Related Art

As a signal cable for an imaging device used in autonomous driving (self-driving) or the like, and as an appliance wiring (in-device wiring) for an electronic device such as a tablet terminal notebook personal computer, a smartphone, fine coaxial cables have been used (See e.g., Japanese Patent No. 6164844).

[Patent Document 1] Japanese Patent No. 6164844

SUMMARY OF THE INVENTION

For the electronic devices and the like in recent years, the signal transmission speed becomes higher. For example, a coaxial cable having high transmission characteristics in which signal attenuation is unlikely to occur even in the case of transmitting very high-speed signals such as signals of 70 GHz or more has been desired. In particular, the coaxial cable used as an in-device wiring is often wired in a bent state. Therefore, it has been desired to achieve a coaxial cable in which the attenuation of the high-speed signal is small even when being wired in a bent state.

Accordingly, it is an object of the present invention to provide a coaxial cable capable of suppressing the attenuation of the high-speed signal even when being wired in a bent state.

For the purpose of solving the above problems, the present invention provides a coaxial cable, comprising: an inner conductor; an insulator covering a circumference of the inner conductor; a shield layer covering a circumference of the insulator; and a sheath covering a circumference of the shield layer, wherein the inner conductor is composed of first metal strands that are twisted each other in such a manner that a cross-sectional shape of the inner conductor is circular, wherein the shield layer comprises a winding shield layer including second metal strands spirally wound around the insulator, and a shield tape layer comprising a shield tape including a resin tape and a metal layer provided on one side of the resin tape, the shield tape being spirally wound around the winding shield layer with the metal layer being located inwardly radially in such a manner that the metal layer is being in contact with the winding shield layer, wherein the winding shield layer has a gap in at least one location between the second metal strands adjacent to each other in a circumferential direction, and a sum of distances w between the second metal strands adjacent to each other via the gap is not more than an outer diameter d of the second metal strand in a cross-section perpendicular to a longitudinal direction.

Points of the Invention

According to the present invention, it is possible to provide a coaxial cable capable of suppressing the attenuation of the high-speed signal even when being wired in a bent state.

DETAILED DESCRIPTION OF THE PREFERRED EMBODIMENTS

Embodiment

An embodiment of the present invention will be described below in conjunction with the accompanying drawings.

Figure 1:
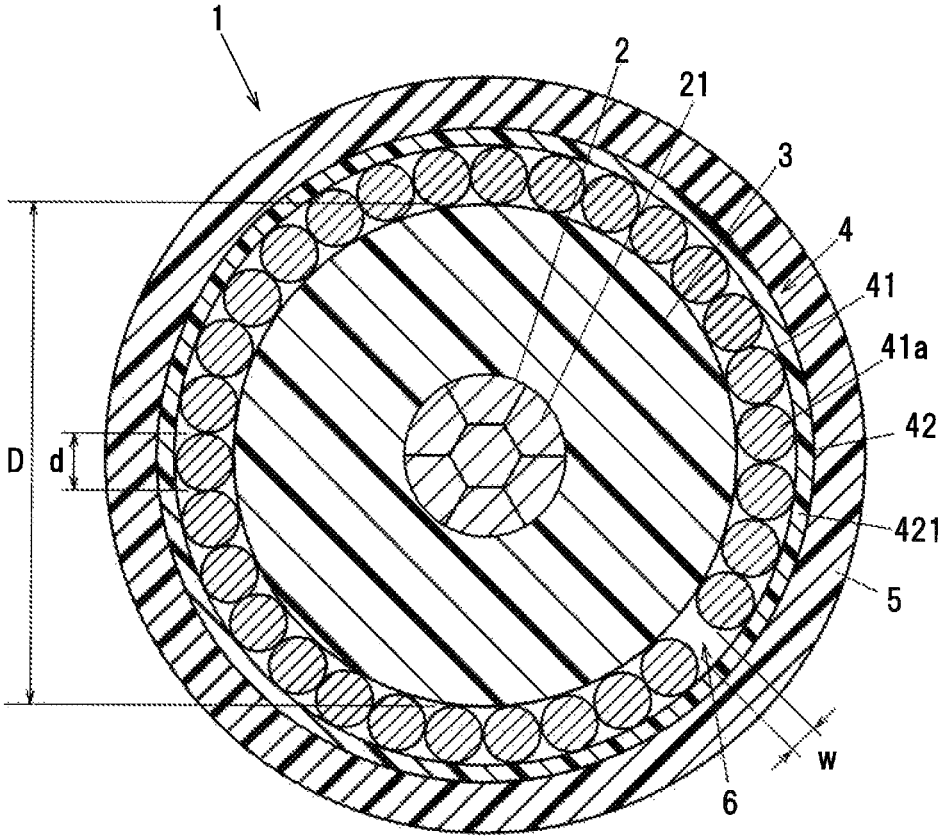
FIG. 1 is a cross-sectional view showing a cross-section in a direction perpendicular to a longitudinal direction of a coaxial cable according to one embodiment of the present invention.

FIG. 1 is a cross-sectional view showing a cross-section in a direction perpendicular to a longitudinal direction of a coaxial cable according to one embodiment of the present invention.

As shown in FIG. 1, a coaxial cable 1 includes an inner conductor 2, an insulator 3 covering the circumference of the inner conductor 2, a shield layer 4 covering the circumference of the insulator 3, and a sheath 5 covering the circumference of the shield layer 4. The coaxial cable 1 is used, for example, as a signal cable for an imaging device used in autonomous driving or the like, and as an in-device wiring for an electronic device such as a tablet terminal, a notebook computer, a smartphone. The coaxial cable 1 has an outer diameter of 2 mm or less, more preferably 1.5 mm or less.

(Inner Conductor 2)

In order to obtain good transmission characteristics, the electrical conductivity of the inner conductor 2 is desirably 99% IACS or more. In order to improve the electrical conductivity of the inner conductor 2, it is conceivable to use a single-wire conductor. In this case, however, the coaxial cable 1 may easily break when repeatedly being bent. Further, the coaxial cable 1 tends to break due to scratches on the inner conductor 2 when the terminal processing is performed by using a laser. Meanwhile, it is difficult to achieve the electrical conductivity of 99% IACS or more by using the inner conductor 2 which is formed by simply twisting a plurality of wires.

Therefore, in the present embodiment, the inner conductor 2 is formed by twisting first metal strands 21 without gaps in such a manner that a cross-sectional shape of the inner conductor 2 is circular. More specifically, as the inner conductor 2, a compressed stranded conductor which is formed by twisting the plurality of first metal strands 21 and compressing the twisted first metal strands 21 so that the cross-sectional shape perpendicular to a cable longitudinal direction is circular. By using a compressed stranded conductor as the inner conductor 2, since the plurality of first metal strands 21 are in close contact with each other and the gaps between the plurality of first metal strands 21 are eliminated, so that the electrical conductivity is improved and good transmission characteristics can be obtained, thereby it is possible to maintain the ease of bending. Further, the compressed stranded conductor does not easily break when being bent as compared to a single-wire conductor. Here, twisting the plurality of first metal strands 21 without gaps is to twist the plurality of first metal strands 21 in the state where the outer surfaces of the adjacent first metal strands 21 are in contact with each other, e.g., in face contact, and there is no gap between the first metal strands 21 being in contact with each other. However, the present invention is not limited thereto and the gap which is in a range that does not affect the effect of the present invention is acceptable.

To achieve a high electrical conductivity, as the first metal strand 21 to be used for the inner conductor 2, it is preferable to use a non-plated soft copper wire made of pure copper. However, a plating with an electrical conductivity of 99% IACS or more plating may be applied, and for example, a silver-plated soft copper wire made of pure copper may be used as the first metal strand 21. In the compression stranded conductor, the distortion is applied to the first metal strands 21 in the compression step so that the electrical conductivity is reduced. However, after this compression step, by performing heat treatment (annealing) to remove the distortion, it is possible to realize the electrical conductivity 99% IACS or more.

(Insulator 3)

As the insulator 3, in order to improve the transmission characteristics of the high-frequency signal (specifically, in order to suppress the attenuation when transmitting high-frequency signals with a band width of e.g. 70 MHz to 100 GHz), it is desirable to use a material with a dielectric constant as low as possible. As the insulator 3, in consideration of the usage of electronic devices, etc., it is desirable to use a material with a stable dielectric constant at a temperature of −40° C. or more and 80° C. or less. Therefore, in order to satisfy these characteristics, the insulator 3 made of a fluorine resin is used in the present embodiment. As the fluorine resin used for the insulator 3, PFA (perfluoroalcoxyalkan), FEP (ethylene tetrafluoride hexafluoride propylene co-polymer), PTFE (polytetrafluoroethylene) and the like may be used. By using the fluorine resin for the insulator 3, the surface of the insulator 3 becomes slippery. When the coaxial cable 1 is being bent, second metal strands 41*a* constituting a winding shield layer 41 to be described later will easily move in the cable longitudinal direction, so that it is possible to further suppress the occurrence of a gap between the winding shield layer 41 and the insulator 3.

Although it is conceivable to use a foamed resin as the insulator 3, since the outer diameter of the coaxial cable 1 has a small diameter such as 2 mm or less, the thickness of the insulator 3 becomes very thin. Since it is difficult to stably produce a thin foamed resin, a fluorine resin with a relatively low dielectric constant is used as the insulator 3 in the present embodiment.

(Sheath 5)

The shield layer 4 is provided around the insulator 3, and the sheath 5 is provided to cover the shield layer 4. In the present embodiment, the sheath 5 is made of a fluorine resin similarly to the insulator 3. As the fluorine resin used for the sheath 5, PFA, FEP, PTFE, etc. may be used. The outer diameter of the sheath 5 is 2.0 mm or less, more preferably 1.5 mm or less.

(Shield Layer 4)

In the present embodiment, the shield layer 4 includes the winding shield layer 41, which is formed by spirally winding (i.e. by lateral winding) the plurality of second metal strands 41*a* around the insulator 3, and a shield tape layer 42, which is formed by spirally winding a shield tape 421 around the winding shield layer 41.

In order to obtain good transmission characteristics, the electrical conductivity of the winding shield layer 41 is desirable to be as high as possible. Therefore, as the second metal strands 41*a*, similarly to the first metal strands 21 described above, a non-plated soft copper wire made of pure copper may be used. However, a plating with an electrical conductivity of 99% IACS or more plating may be applied, and for example, a silver-plated soft copper wire made of pure copper may be used as the second metal strand 41*a*. As the second metal strand 41*a*, it is preferable to use a metal strand with a smaller diameter than the diameter of the first metal strand 21 used for the inner conductor 2. Here, the second metal strand 41*a* with the outer diameter of 0.05 mm is used. In FIG. 1, although the lateral cross-sectional shape of the second metal strand 41*a* is shown in a circular shape, the lateral cross-sectional shape of the second metal strand 41*a* may be an elliptical shape.

By winding the second metal strands 41*a*, as compared with the case of using e.g. a braided shield formed by braiding metal strands, the coaxial cable 1 is easy to bend so that it is possible to obtain the coaxial cable which is easy to be being wired in a narrow space or the like in the device.

Figure 2:
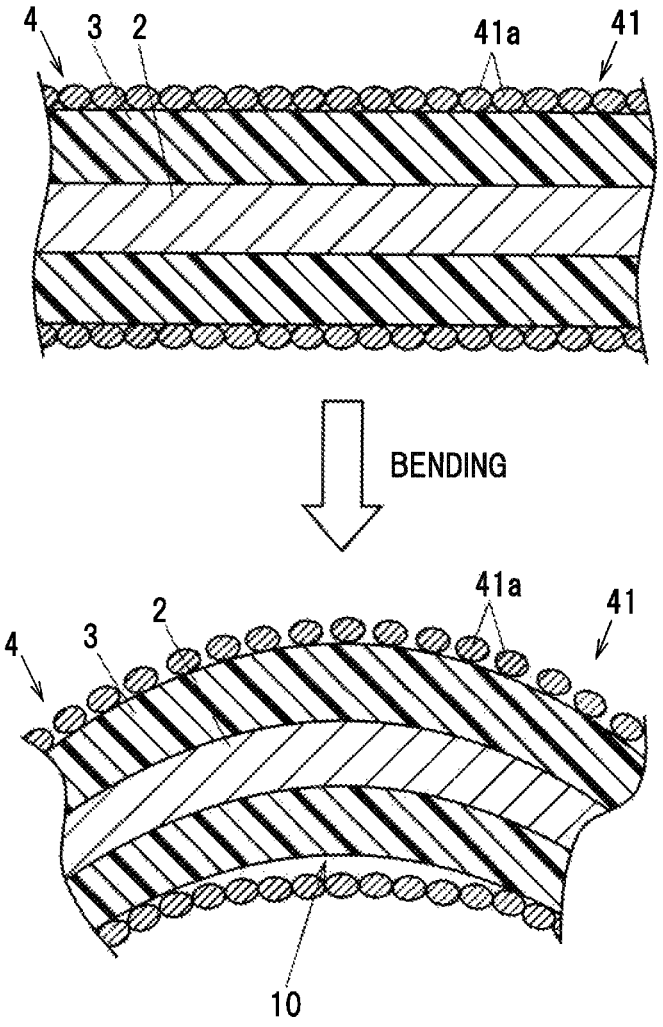
FIG. 2 is an explanatory view illustrating that a gap occurs between an insulator and a winding shield layer due to bending in a coaxial cable of a conventional example.

Here, the behavior of the second metal strands 41*a* when bending the coaxial cable 1 will be examined. In the case of winding the second metal strands 41*a* without gaps as shown in FIG. 2, when the coaxial cable 1 is bent, there will be no relief for the second metal strands 41*a* inside a bending (lower side in FIG. 2), so that the second metal strands 41*a* will float from the insulator 3. That is, in the case of winding the second metal strands 41*a* without gaps, when the coaxial cable 1 is bent, a gap 10 will occur between the insulator 3 and winding shield layer 41 inside the bending.

The characteristic impedance of the coaxial cable 1 largely depends on a distance between the inner conductor 2 and the shield layer 4 and a dielectric constant between the inner conductor 2 and the shield layer 4. Therefore, when the gap 10 is generated, the characteristic impedance in a part in which the gap 10 is generated, i.e. a bending portion of the coaxial cable 1 will change significantly with respect to the characteristic impedance of the other part. As a result, a return loss will be increased so that a signal attenuation will be increased, the effect becomes very large, especially when transmitting the high-speed signals. In order to suppress the occurrence of the gap 10, it will be sufficient to provide a space for relieving the second metal strands 41*a* inside the bending in such a manner that the second metal strands 41*a* can follow the movement of the insulator 3 even when the coaxial cable 1 is bent.

Figure 3:
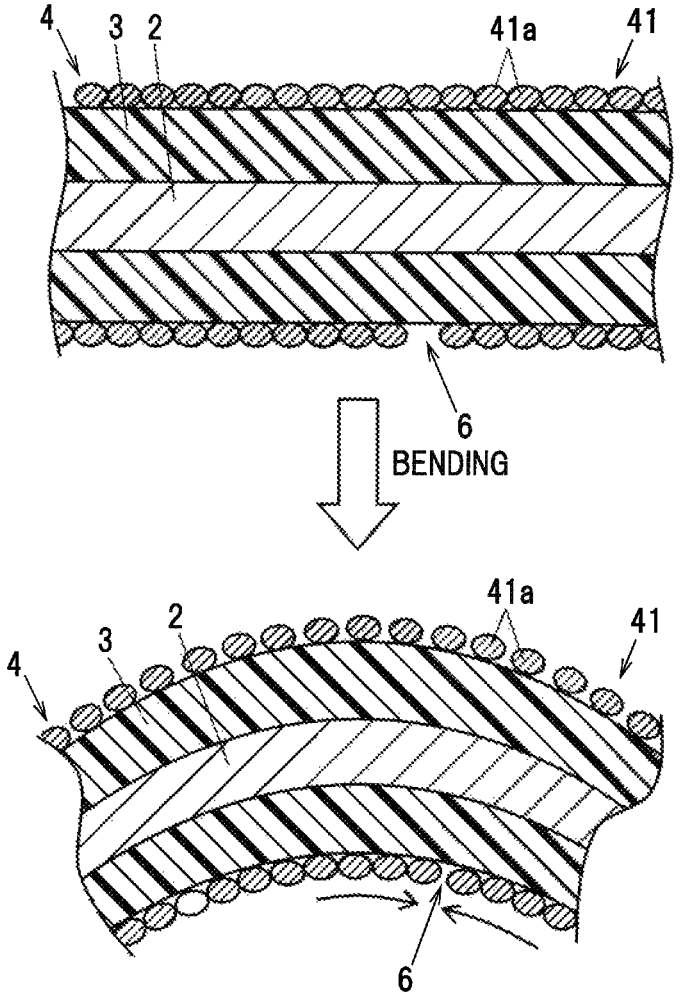
FIG. 3 is an explanatory view illustrating that a gap does not occur between an insulator and a winding shield layer due to bending in the coaxial cable of the present invention.

Therefore, in the coaxial cable 1 according to the present embodiment, in the winding shield layer 41, a gap (space, or vacant space) 6 is formed in at least one location between the second metal strands 41*a* adjacent to each other in a circumferential direction, and a sum (total value) of distances w between the second metal strands 41*a* adjacent to each other via the gap 6 (hereinafter, referred to as a width w of the gap 6) is set to be not more than an outer diameter d of the second metal strand 41*a* in a cross-section perpendicular to the longitudinal direction. Since the gap 6 is provided spirally, so that gap 6 is present between the second metal strands 41*a* adjacent to each other even in a cross section parallel to the longitudinal direction. Thus, as shown in FIG. 3, when the coaxial cable 1 is bent, the second metal strand 41*a* can escape into the gap 6 inside the bending (i.e. the second metal strand 41*a* moves to the gap 6 side in such a manner that the gap 6 is reduced), it is possible to maintain the state that the second metal strands 41*a* are in close contact with the insulator 3. As a result, it is possible to suppress the change in characteristic impedance in the bent portion of the coaxial cable 1, to thereby suppress the signal attenuation. In FIGS. 2 and 3, the shield tape layer 42 and the sheath 5 are omitted for the purpose of explanation.

In the present embodiment, the case where the gap 6 is formed only in one location between the second metal strands 41*a* adjacent to each other in the circumferential direction is explained, but the present invention is not limited thereto. The gaps 6 may be dispersed in two or more locations. Further, the position of the gap 6 may be changed in the longitudinal direction.

More preferably, the sum of the widths w of the gaps 6 is not less than 0.5 times and not more than 1.0 time of the outer diameter d of the second metal strand 41*a*. By setting the sum of the widths w of the gaps 6 to be not less than 0.5 times, the above gap 10 is less likely to occur when the coaxial cable 1 is bent. Meanwhile, by setting the sum of the widths w of the gaps 6 to be not more than 1.0 time of the outer diameter d of the second metal strand 41*a*, it is possible to suppress the deterioration in transmission characteristics when the gap 6 becomes too large and the electric field distribution becomes unbalanced. Here, the term "the sum of the widths w of the gaps 6" represents the sum of the widths w of the gaps 6 in a state where the coaxial cable 1 is provided in a straight line without being bent.

The circumference of a circle passing through the centers of the second metal strands 41*a* is represented by $\pi(D+d)$, where the outer diameter of the insulator 3 is D and the outer diameter of the second metal strand 41*a* is d. This value is divided by the outer diameter d of the second metal strand 41*a* as follows:

$$n=\{\pi(D+d)/d\} \quad (1).$$

Here, n obtained by the equation (1) is the number of the second metal strands 41*a* that can be placed on the outer circumference of the insulator 3. The number n can be adjusted by finely adjusting the outer diameter D of the insulator 3. Also, in consideration of the bite of the second metal strands 41*a* to the insulator 3, by forming the winding shield layer 41 using the second metal strands 41*a* with the number which is less than the resulting number n by about 0.6 to 1.5, the sum of the widths w of the gaps 6 can be not less than 0.5 times and not more than 1.0 time of the outer diameter d of the second metal strand 41*a*.

Figure 4:
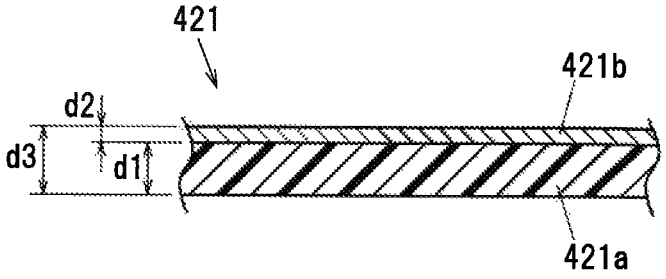
FIG. 4 is a cross-sectional view of a shield tape used for the coaxial cable of the present invention.

In the winding shield layer 41, a gap is likely to occur between the second metal strands 41*a*, such as when the coaxial cable 1 is bent in the first place. The shield tape layer 42 is provided to close such gaps (including the gaps 6 described above), so as to improve the shielding performance. As shown in FIG. 4, the shield tape layer 42 is formed from a shield tape 421 including a resin tape 421*a* and a metal layer 421*b* formed on one side of the resin tape 421*a*. The resin tape 421*a* is made of, e.g., PET (polyethylene terephthalate). The metal layer 421*b* is made of, e.g., copper. The shield tape layer 42 is formed by spirally winding the shield tape 421 around the winding shield layer 41 in the state where the metal layer 421*b* is located inwardly radially in such a manner that the metal layer 421*b* is being in contact with each second metal strand 41*a* of the winding shield layer 41. Further, the shield tape layer 42 is formed by spirally wrapping (lap winding) the shield tape 421, in such a manner that the shield tape 421 partially overlaps in the width direction.

A winding direction of the second metal strands 41*a* in the winding shield layer 41 is preferably the same as a winding direction of the shield tape 421 in the shield tape layer 42. By setting the winding direction of the second metal strands 41*a* to be the same as the winding direction of the shield tape 421, the shield tape 421 can easily follow the movement of the second metal strands 41*a*, so that it is possible to suppress the deterioration in transmission characteristics due to the gaps occurring between the winding shield layer 41 and the shield tape layer 42. Further, by setting the winding direction of the second metal strands 41*a* to be the same as the winding direction of the shield tape 421, the shield tape 421 can follow the movement of the second metal strands 41*a*, so that the coaxial cable 1 can be bent easily. For example, if the winding direction of the second metal strands 41*a* is opposite to the winding direction of the shield tape 421, the second metal strands 41*a* and the shield tape 421 will interfere with each other in movement, so that it is difficult to bend the coaxial cable 1, and wrinkles will occur in the shield tape 421 when the coaxial cable is forcibly bent in this state. In such a case, the transmission characteristics may deteriorate.

Furthermore, by setting the winding direction of the second metal strands 41*a* to be the same as the winding direction of the shield tape 421, it is possible to easily remove the sheath 5 and the shield tape layer 42 during a terminal processing. For example, if the winding direction of the second metal strands 41*a* is opposite to the winding direction of the shield tape 421, the shield tape 421 is hard to escape by being caught in the second metal strands 41*a*. Furthermore, if the shield tape 421 is forcibly pulled out in that state, the second metal strands 41*a* will be loosened and disassembled, so that the transmission characteristics may largely deteriorate at an end of the coaxial cable 1. According to the present embodiment, it is possible to easily pull out the shield tape 421 along the second metal strands 41*a*, thereby suppressing the disturbance of the second metal strands 41*a*. As a result, it is possible to suppress the deterioration in transmission characteristics at the end of the coaxial cable 1.

Here, the winding direction of the second metal strands 41*a* is a direction that the second metal strands 41*a* are rotated from the other end side toward the one side when viewed from one end of the coaxial cable 1. Further, the winding direction of the shield tape 421 is a direction that that the shield tape 421 is rotated from the other end side toward the one side when viewed from one end of the coaxial cable 1.

If the shield tape 421 is too thick, the shield tape 421 will not be able to follow the movement of the winding shield layer 41. Further, since that the gap due to a step portion (level difference) at an overlapping part of the shield tape 421 overlaps is enlarged, the transmission characteristics may deteriorate. Therefore, the shield tape 421 is desirably as thin as possible. More specifically, a thickness d3 of the shield tape 421 is preferably not more than 1/10 of the outer diameter d of the second metal strand 41*a*. By setting the thickness d3 to be not more than 1/10 of the outer diameter d of the second metal strand 41*a*, it is possible to suppress that the shield tape 421 cannot follow the movement of the winding shield layer 41, or the gap due to the step portion at the overlapping part of the shield tape 421 is enlarged so that the transmission characteristics may deteriorate.

In addition, a thickness d2 of the metal layer 421*b* of the shield tape 421 is preferably not less than 0.1 μm and not more than 0.5 μm. By setting the thickness d2 to be not less than 0.1 μm, a sufficient shielding effect can be obtained. Meanwhile, by setting the thickness d2 to be not more than 0.5 μm, it is possible to suppress that the shield tape 421 becomes hard so that the shield tape 421 is less likely to follow the movement of the winding shield layer 41.

If the resin tape 421*a* is too thick, the resin tape 421 will become hard so that the shield tape 421 will not be able to follow the movement of the winding shield layer 41. Therefore, the resin tape 421*a* is desirably as thin as possible. More specifically, a thickness d1 of the resin tape 421*a* is set in such a manner than a ratio d1/d2 of the thickness d1 of the resin tape 421*a* to the thickness d2 of the metal layer 421*b* is preferably less than 3/40. By setting the ratio d1/d2 to be less than 3/40, it is possible to suppress that the shield tape 421 becomes hard and is less likely to follow the movement of the winding shield layer 41.

Further, a winding pitch of the shield tape 421 is desirably to be close to a winding pitch of the second metal strands 41*a* as much as possible. More specifically, the winding pitch of the shield tape 421 is preferably twice the winding pitch of the second metal strands 41*a*. This is because when the winding pitch of the shield tape 421 is too large, it is difficult for the shield tape 421 to follow the movement of the winding shield layer 41.

For example, it is also conceivable to provide the shield tape layer 42 between the insulator 3 and the winding shield layer 41, such a structure is not preferable since it may lead to the deterioration in transmission characteristics. When transmitting the high-speed signals, a ratio of an electric current flowing through a radially inner edge of the shield layer 41 is increased by the skin effect (surface effect). When the shield tape layer 42 is provided at the radially inner edge of the shield layer 41 where a lot of the electric current flows, a phenomenon called "sack-out" that is a large attenuation occurring at a particular frequency may occur, since the shield tape layer 42 has a structure that a conductor (metal layer 421*b*) and an insulator (resin tape 421*a*) are provided periodically in the longitudinal direction. In order to suppress such a sack-out, the shield tape layer 42 is provided on the outer circumference of the winding shield layer 41.

(Function and Effect of the Embodiment)

In the coaxial cable 1 according to the present embodiment, the inner conductor 2 is composed of the first metal strands 21 that are twisted each other without any gap in such a manner that the cross-sectional shape of the inner conductor 2 is circular, and the winding shield layer 41 has the gap 6 in at least one location between the second metal strands 41*a* adjacent to each other in the circumferential direction.

Since the inner conductor 2 is composed of the first metal strands 21 that are twisted each other without any gap in such a manner that the cross-sectional shape of the inner conductor 2 is circular, the inner conductor 2 is less likely to break even after being repeatedly bent, and it is possible to improve the electrical conductivity, to thereby improve the transmission characteristics when transmitting a high-speed signal. Furthermore, the gap 6 is provided between the second metal strands 41*a*, and the sum of the distances w between the second metal strands 41*a* adjacent to each other via the gap 6 is not more than the outer diameter d of the second metal strand 41*a*, since the gap 10 is less likely to occur between the winding shield layer 41 and the insulator 3 even in the part where the coaxial cable 1 is bent, so that it is possible to keep the same distance between the inner conductor 2 and the shield layer in the bent portion as a distance between the inner conductor 2 and the shield layer 4 in a non-bent portion. As a result, it is possible to suppress the change in characteristic impedance in the bent portion, and to improve the transmission characteristics when transmitting high-speed signals.

In other words, according to the present embodiment, it is possible to realize the coaxial cable 1 which is capable of suppressing the attenuation of the high-speed signal even when being wired in a bent state. More specifically, even when the coaxial cable 1 is wired with being bent, it is possible to suppress the error of the characteristic impedance to be about 1% (e.g., 50Ω±0.5Ω), and it is possible to realize very high transmission characteristics suitable for the next-generation high-speed transmission at such as 70 GHz or more.

Summary of the Embodiment

Next, the technical ideas grasped from the above-described embodiments will be described with the aid of the reference characters and the like in the embodiments. It should be noted, however, the each of the reference characters and the like in the following descriptions is not to be construed as limiting the constituent elements in the appended claims to the members and the like specifically shown in the embodiments.

[1] A coaxial cable (1), comprising: an inner conductor (2); an insulator (3) covering a circumference of the inner conductor (2); a shield layer (4) covering a circumference of the insulator (3); and a sheath (5) covering a circumference of the shield layer (4), wherein the inner conductor (2) is composed of first metal strands (21) that are twisted each other in such a manner that a cross-sectional shape of the inner conductor (2) is circular, wherein the shield layer (4) comprises a winding shield layer (41) including second metal strands (41*a*) spirally wound around the insulator (3), and a shield tape layer (42) comprising a shield tape (421) including a resin tape (421*a*) and a metal layer (421*b*) provided on one side of the resin tape (421*a*), the shield tape (421) being spirally wound around the winding shield layer (41) with the metal layer (421*b*) being located inwardly radially in such a manner that the metal layer (421*b*) is being in contact with the winding shield layer (41), wherein the winding shield layer (41) has a gap (6) in at least one location between the second metal strands (41*a*) adjacent to each other in a circumferential direction, and a sum of distances w between the second metal strands (41*a*) adjacent to each other via the gap (6) is not more than an outer diameter d of the second metal strand (41*a*) in a cross-section perpendicular to a longitudinal direction.

[2] The coaxial cable (1) according to [1], wherein the sum of the distances w between the second metal strands (41*a*) adjacent to each other via the gap (6) is not less than 0.5 times and not more than 1.0 time of the outer diameter d of the second metal strand 41*a* in the cross-section perpendicular to the longitudinal direction.

[3] The coaxial cable (1) according to [1] or [2], wherein a winding direction of the second metal strands (41*a*) in the winding shield layer (41) is the same as a winding direction of the shield tape (421) in the shield tape layer (42).

[4] The coaxial cable (1) according to any one of [1] to [3], wherein the second metal strand (41*a*) comprises pure copper, or pure copper which is silver-plated on a surface.

[5] The coaxial cable (1) according to any one of [1] to [4], wherein a thickness of the metal layer (421*b*) of the shield tape (421) is not less than 0.1 μm and not more than 0.5 μm.

[6] The coaxial cable (1) according to [5], wherein a ratio d1/d2 is less than 3/40, where the thickness of the resin tape (421*a*) is d1 and a thickness of the metal layer (421*b*) is d2.

[7] The coaxial cable (1) according to any one of [1] to [6], wherein a thickness of the shield tape (421) is not more than 1/10 of the outer diameter d of the second metal strand (41*a*).

[8] The coaxial cable (1) according to any one of [1] to [7], wherein the insulator (3) comprises a fluorine resin.

Although the embodiments of the present invention have been described above, the above described embodiments are not to be construed as limiting the inventions according to the appended claims. Further, it should be noted the not all the combinations of the features described in the embodiments are indispensable to the means for solving the problem of the invention. Further, the present invention can be appropriately modified and implemented without departing from the spirit thereof.

What is claimed is:

1. A coaxial cable, comprising:

an inner conductor;

an insulator covering a circumference of the inner conductor;

a shield layer covering a circumference of the insulator; and a sheath covering a circumference of the shield layer, wherein the inner conductor is composed of first metal strands that are twisted each other in such a manner that a cross-sectional shape of the inner conductor is circular, wherein the shield layer comprises a winding shield layer including second metal strands spirally wound around the insulator, and a shield tape layer comprising a shield tape including a resin tape and a metal layer provided on one side of the resin tape, the shield tape being spirally wound around the winding shield layer with the metal layer being located inwardly radially in such a manner that the metal layer is being in contact with the winding shield layer, wherein the winding shield layer has a gap in at least one location between the second metal strands adjacent to each other in a circumferential direction, and a sum of each of distances w between the second metal strands adjacent to each other via the gap is not more than an outer diameter d of the second metal strand in a cross-section perpendicular to a longitudinal direction.

2. The coaxial cable according to claim 1, wherein the sum of the distances w between the second metal strands adjacent to each other via the gap is not less than 0.5 times and not more than 1.0 time of the outer diameter d of the second metal strand 41*a* in the cross-section perpendicular to the longitudinal direction.

3. The coaxial cable according to claim 1, wherein a winding direction of the second metal strands in the winding shield layer is the same as a winding direction of the shield tape in the shield tape layer.

4. The coaxial cable according to claim 1, wherein the second metal strand comprises pure copper, or pure copper which is silver-plated on a surface.

5. The coaxial cable according to claim 1, wherein a thickness of the metal layer of the shield tape is not less than 0.1 μm and not more than 0.5 μm.

6. The coaxial cable according to claim 5, wherein a ratio d1/d2 is less than 3/40, where the thickness of the resin tape is d1 and a thickness of the metal layer is d2.

7. The coaxial cable according to claim 1, wherein a thickness of the shield tape is not more than 1/10 of the outer diameter d of the second metal strand.

8. The coaxial cable according to claim 1, wherein the insulator comprises a fluorine resin.

* * * * *